US006273562B1

(12) United States Patent
Deshmukh

(10) Patent No.: US 6,273,562 B1
(45) Date of Patent: Aug. 14, 2001

(54) INK JET PRINTER PEN VENT FACILITY

(75) Inventor: Govind Sanjeevanrao Deshmukh, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/538,326

(22) Filed: Mar. 29, 2000

(51) Int. Cl.[7] ..... B41J 2/175
(52) U.S. Cl. ..... 347/86; 347/87
(58) Field of Search ..... 347/86, 87; 454/270, 454/302, 301, 254; 346/140.1

(56) References Cited

U.S. PATENT DOCUMENTS 5,629,728 * 5/1997 Karita et al. ..... 347/87

FOREIGN PATENT DOCUMENTS 33 11 338 A1 * 10/1984 (DE) ..... H01H/13/18
40 25 319 A1 * 2/1992 (DE) ..... B41J/2/17

* cited by examiner

*Primary Examiner*—David F. Yockey

(57) ABSTRACT

An inkjet pen has a body enclosing an ink reservoir and defining a vent aperture. A vent plug defining an elongated serpentine channel occupies the aperture. The plug may be cylindrical, with smaller diameter pilot ends to facilitate insertion. The serpentine channel may include several segments that alternate in direction, and which occupy a major portion of the plug surface away from an elongated spine surface portion that extends the length of the plug without interruption by the channel.

5 Claims, 3 Drawing Sheets

FIG. 3
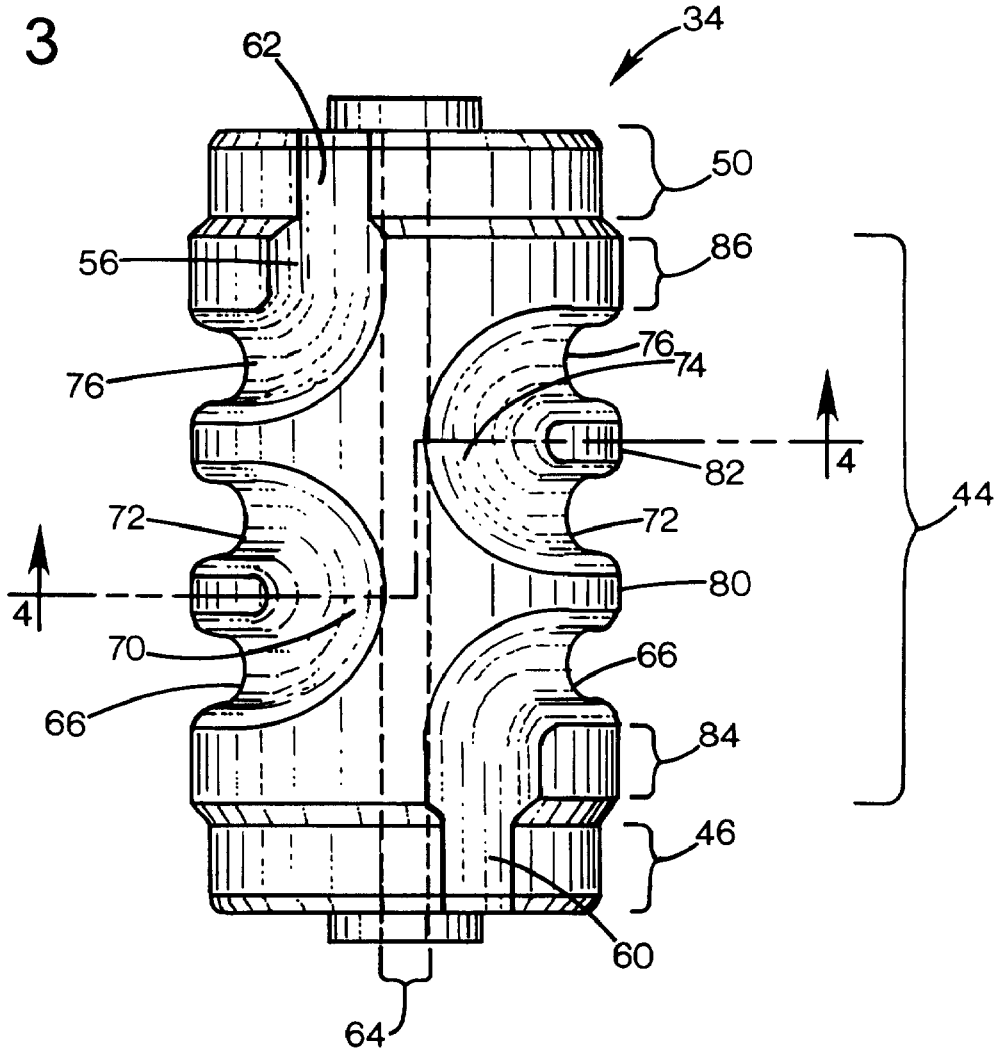
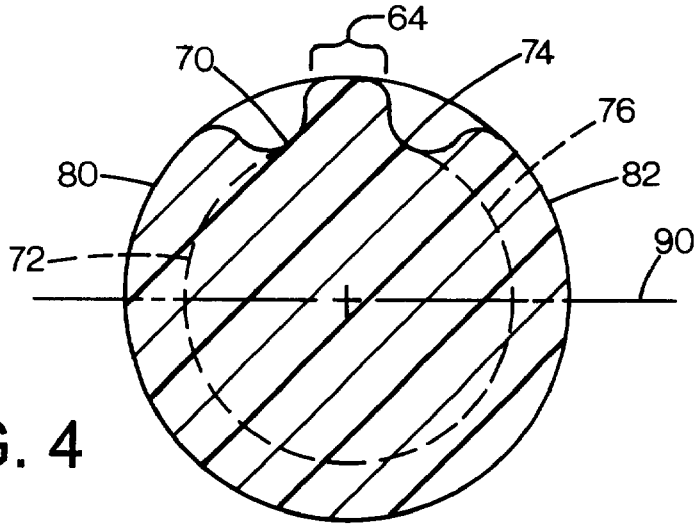
FIG. 4

INK JET PRINTER PEN VENT FACILITY

FIELD OF THE INVENTION

This invention relates to ink jet printers, and particularly to ventilation of ink jet pens.

BACKGROUND AND SUMMARY OF THE INVENTION

A typical ink jet printer has a pen that reciprocates over a printable surface such as a sheet of paper. The pen includes a print head having an array of numerous orifices through which droplets of ink may be expelled onto the surface to generate a desired pattern. The pen includes a body defining an ink chamber containing a supply of ink. Other printer formats may employ a fixed remote supply that supplies ink to a reciprocating pen. In such cases, for the purposes of this disclosure, the remote supply is considered part of the pen.

Many ink jet printing systems employ pens with rigid ink supply reservoirs that must be vented to admit air to compensate for the volume of ink that is consumed during printing. This prevents the development of a partial vacuum that can inhibit further printing. In addition, it also allows equalization of pressure differentials caused changes in temperature and atmospheric pressure. Without a vent, when the ink chamber exceeds ambient pressure, ink may be forced out of the printing orifices, causing associated problems.

Existing ink supply chambers are normally vented by an aperture in which a small cylindrical vent plug is inserted. The plug has a helically grooved exterior surface, with a V-shaped groove that provides an elongated narrow path for gradual equalization of pressure differences. The path is long and narrow enough to prevent significant air exchange in an atmospherically stable environment; a large vent opening would allow pressure differences. The path is long and narrow enough to prevent significant air exchange in an atmospherically stable environment; a large vent opening would allow evaporation and drying of the ink in the reservoir. Such existing plugs are formed in the shape of a headless threaded machine screw, of a plastic material such as nylon. The sharp vertices of the threads are intended to crush slightly to provide a tight fit in the pen housing aperture, preventing air flow other than via the single thread channel.

While effective for venting, existing plug designs occasionally experience difficulties during installation. The plug may become angularly offset initially, and insertion forces can bend the plug or cause damaging crushing of the threads on one side of the plug, blocking the vent channel and causing pen failure when ink consumption generates an unrelieved vacuum in the chamber. In addition, the helically threaded design may generate an uneven buckling response to axial forces, and may respond unevenly to initial insertion where one side of the plug end has a raised thread peak and the other has a groove. Further, the softness of threads and the sharp vertex design needed to allow slight crushing for an interference fit may be damaged by the imbalanced forces of bending, buckling, and offset insertion.

The present invention overcomes the limitations of the prior art by providing an inkjet pen having a body enclosing an ink reservoir and defining a vent aperture. A vent plug defining an elongated serpentine channel occupies the aperture. The plug may be cylindrical, with smaller diameter pilot ends to facilitate insertion. The serpentine channel may include several segments that alternate in direction, and which occupy a major portion of the plug surface away from an elongated spine surface portion that extends the length of the plug without interruption by the channel.

BRIEF DESCRIPTION OF THE DRAWINGS

FIG. 3 is a side view of the vent plug of the embodiment of FIG. 1.

FIG. 4 is a sectional end view of the vent plug of the embodiment of FIG. 1 taken along line 4—4 of FIG. 3.

DETAILED DESCRIPTION OF A PREFERRED EMBODIMENT

Figure 1:
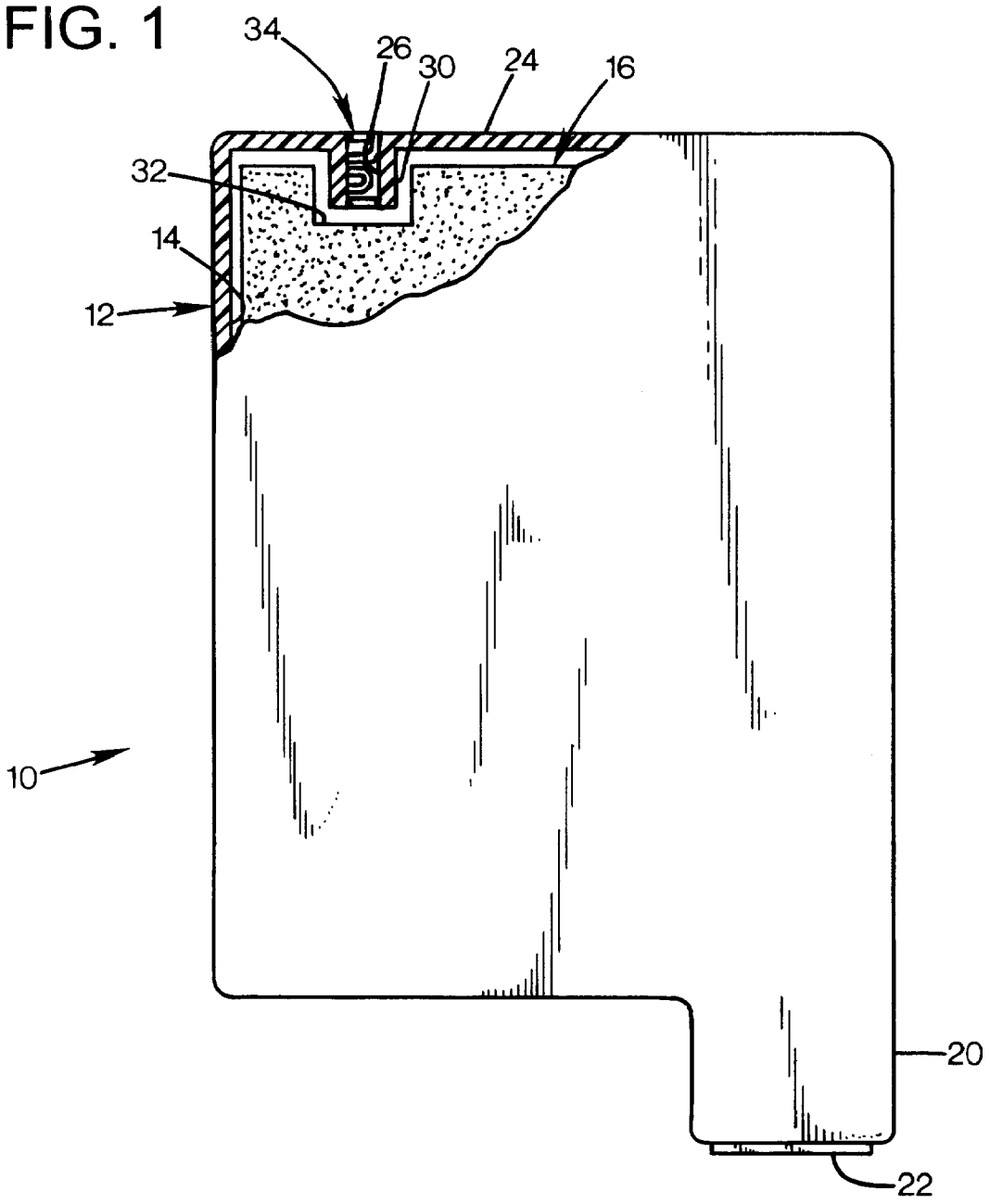
FIG. 1 is a sectional side view of an ink jet pen according to a preferred embodiment of the invention.

FIG. 1 shows an ink jet pen 10 having a housing 12 defining an ink chamber or reservoir 14 containing a block of ink-saturated foam 16. A lower sump portion of the housing 20 supports an ink jet print head 22 that faces down in the illustrated orientation to expel ink droplets downwardly onto a media sheet (not shown) oriented parallel to the print head.

At an upper wall 24 of the housing 12, a vent bore aperture 26 is defined in a boss 30 that extends into the chamber 14. The foam element 16 is provided with a notch 32 to ensure that the foam is spaced apart from the boss 30, preventing ink from wicking into the aperture. A generally cylindrical vent plug 34 is closely received in the aperture 26.

Figure 2:
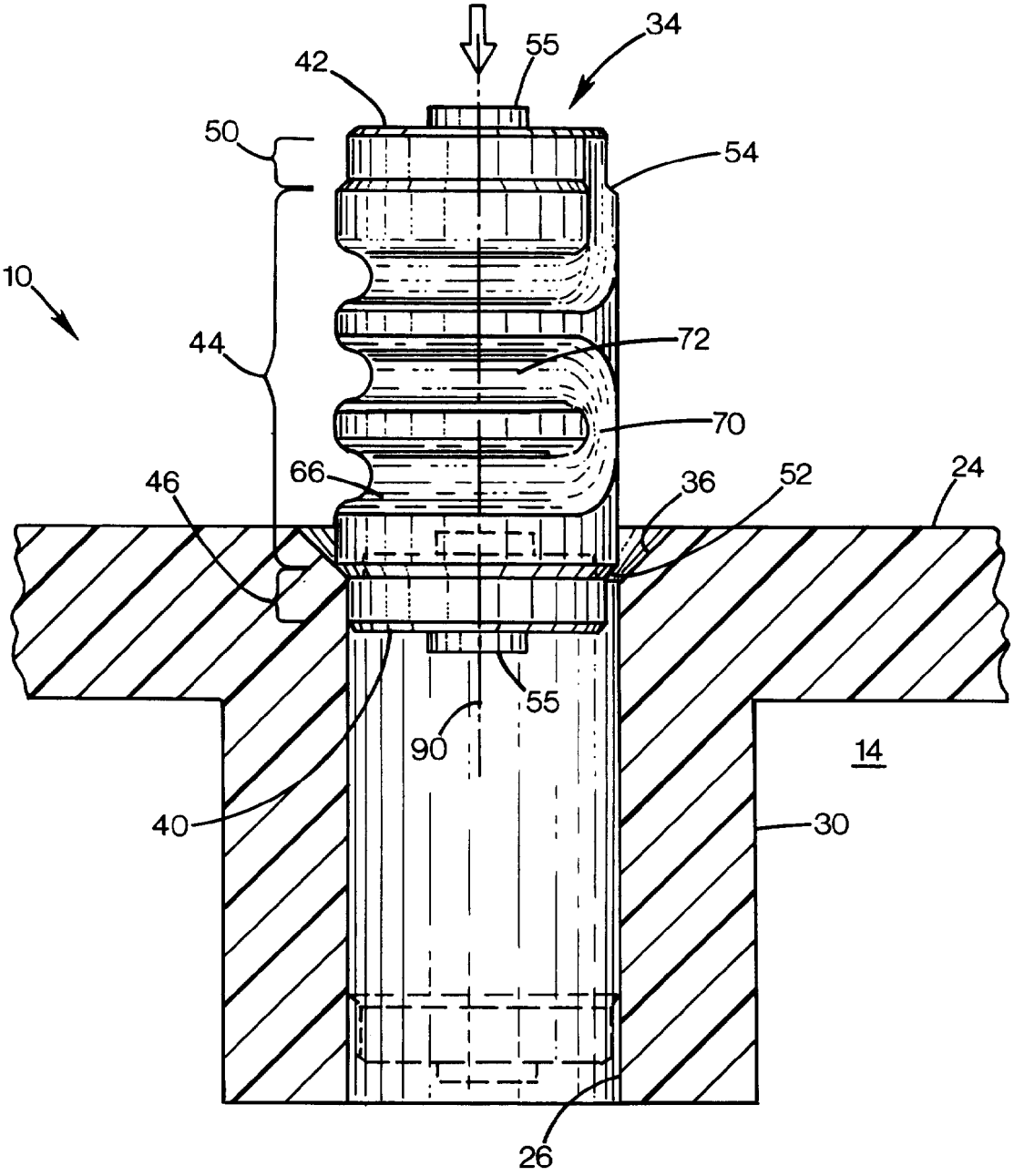
FIG. 2 is an enlarged sectional view of the embodiment of FIG. 1.

FIG. 2 shows the plug 34 in a position just prior to installation in the bore 26, which includes a chamfer 36 at an external surface of the upper wall 24 to facilitate lead-in during installation. The plug 34 is a cylindrical body having a first end 40 extending downward toward the chamber 14, and a second end 42 extending upward toward the exterior of the pen 10. The plug includes an intermediate portion 44 extending most of the length of the plug, and having a constant diameter sized slightly larger than the diameter of the bore 26 to provide a slight interference fit upon insertion.

A pilot portion 46, 50 coaxially extends from each end of the intermediate portion 44, each pilot portion having a diameter smaller than the intermediate portion, and slightly smaller than the diameter of the bore 26 to provide a close slip fit in the bore. A chamfer 52, 54, provides a transition between the different diameters of the intermediate and pilot portions, and provides a guide surface that contacts the bore chamfer 36 as shown, to center a laterally offset plug upon axial insertion force. The pilot portion has adequate length relative to the bore diameter to resist the plug from being tilted out of the aligned position when the pilot portion is inserted in the bore. A central protrusion 55 at each end of the plug is an artifact of injection molding gates, and is largely trimmed during manufacturing. Any remaining protrusion serves to ensure than an axial force directed toward the end of the plug by a flat tool will tend to act axially on the plug. As fully inserted in the bore, the gate protrusion 55 at the upper end is approximately flush with the upper surface 24 of the pen, so that an insertion tool having a larger diameter than the bore is stopped at the pen surface to limit insertion depth.

As shown in FIG. 3, the plug 34 defines an articulated or serpentine channel 56 that extends from a first end 60 that communicates with the pen chamber and which penetrates the surface of the first pilot portion 46, to a second channel end 62 that communicates with the exterior and which penetrates the surface of the second pilot portion 50. The channel is articulated or serpentine in the sense that it has a series of bends, which cause the path to proceed in one direction then another, back and forth to provide a lengthy channel in an area having dimensions much smaller than the channel length. The channel is essentially articulated in the sense of a switchback road.

However, while a serpentine path may provide a lengthy path on a flat area, the preferred embodiment wraps that area about the majority of the cylindrical wall surface of the plug.

The serpentine or articulated channel of the preferred embodiment is unlike a helical channel, which proceeds in a constant path direction with respect to the local surface in which it is defined. In addition, while a helical channel necessarily intersects each longitude line on the surface of a cylinder in which is it is defined, an articulated channel as illustrated may reverse directions as needed to avoid crossing an unbroken spine region 64, as will be discussed below.

The channel begins with the first channel portion 60, which is a roughly semi-cylindrical path extending parallel to the plug axis and adjacent to the spine region 64. The channel bends 90 degrees in a direction away from the spine region, an proceeds with a first circumferential segment 66 that extends about nearly the entire circumference of the plug in a clockwise direction as viewed from the first end 46, until it nearly meets the spine region 64. The first circumferential segment, like the second and third segments to be discussed below, occupies a plane perpendicular to the plug axis. A first U-shaped or hairpin bend 70 reverses the channel direction by 180 degrees to avoid intersecting the spine region, and connects to a second circumferential segment 72 parallel to the first, and spaced apart from it and positioned at a medial position along the length of the plug.

The second segment 72 extends about the plug in a counter-clockwise direction as viewed from the first end 46, terminates at another U-shaped hairpin bend 74, which reverses the direction, connecting to a third segment 76. The third segment, like the first and second, is oriented in a plane perpendicular to the plug axis, and avoids crossing the spine region 64, connecting to a 90 degree bend that connects to the second end segment 62 adjacent to the spine region on a side of the spine region opposite the first end segment 60.

The channel segments 66, 72, 76 are spaced apart from each other by ridge portions 80, 82 having broad straight cylindrical surfaces that provide resistance to distortion and crushing during insertion, and which prevent leakage from one channel segment to the next. An even broader straight cylindrical surface portion 84, 86 is provided at each end of the intermediate portion 44, beyond the first and third channel segments 66, 76. This provides a solid surface to avoid crushing collapse of the channels due to significant insertion forces.

As shown in FIG. 4, the spine region 64 is positioned away from a parting plane 90 of the plug, at the most remote possible point, or 90 degrees away from the intersections of the parting plane and the plug surface. This ensures that there are no undercuts that would make molding difficult. Thus, each surface portion of the entire plug faces in a direction defined by an associated local normal line that does not intersect the parting plane as the line extends away from the surface. In alternative designs, very slight undercuts may be tolerated due to normal shrinkage following molding, enabling minuscule undercuts to be cleared for ejection of the plug from the molding tool. In such cases where simple two-part molds are used, the part is considered not to have undercuts.

The spine provides resistance against bending, particularly in a direction that would cause the spine to compress or extend. Buckling in a lateral direction (that which would cause the plug axis to bend, but to remain in the parting plane) is avoided by the symmetry of the part. The FIG. 3 view shows that the channel segments are aligned on opposite sides of the plug, and about nearly its entire circumference. This is unlike a conventional helically-threaded plug, which has a groove on one side opposite a ridge on the other. Except for the spine and channel bends near the spine, about three quarters of the surface of the plug is a surface of revolution, and thus enjoys inherent symmetry and resistance to buckling. The plug is also rotationally symmetrical in an end-to-end sense, so that the plug may be inserted with either end first.

In the preferred embodiment, the plug is manufactured of Dupont Zytel® nylon, and has an overall length of 5.14 mm, exclusive of the molding gates. The intermediate portion has a diameter of 2.8 mm, and a length of 4.02 mm; the pilot ends have a length of 0.56 mm and a diameter of 2.55 mm. The pen's vent aperture has a diameter of 2.692 mm. The channel has a width of 0.5 mm, with additional width at the surface due to a radius that avoids corners that may inhibit installation. The channel depth is 0.35 at the intermediate portion, and slightly less at the pilot end portions. The flat surfaces 80, 82 between channels have a width of 0.246 mm, and the surfaces 84, 86 at the ends of the intermediate portion have a width of 0.508 mm. The spine extends the length of the plug, and has a width of 0.246 mm. The external corners defined at the junction of the channel and the adjacent cylindrical surface are radiused to a radius of 0.076 mm.

While the above is discussed in terms of preferred and alternative embodiments, the invention is not intended to be so limited.

What is claimed is:

1. An inkjet pen comprising:

a body enclosing an ink reservoir;

the body defining a vent aperture;

a vent plug occupying the aperture;

the vent plug defining an elongated serpentine channel;

and wherein the plug is a cylindrical body having opposed cylindrical end portions and an intermediate portion, and wherein the end portions have smaller diameters than the intermediate portion.

2. An inkjet ink supply facility comprising:

a body enclosing an ink reservoir;

the body defining a vent aperture;

a vent plug occupying the aperture and defining a vent channel; and the plug being a cylindrical body having opposed cylindrical end portions and an intermediate portion, and wherein the end portions have smaller diameters than the intermediate portion, such that the end portions serve as pilots to facilitate insertion of the plug into the aperture sized to closely receive the intermediate portion.

3. The ink supply facility of claim 2 wherein the channel is defined only in the intermediate portion.

4. The ink supply facility of claim 2 wherein the end portions are straight cylindrical bodies.

5. The ink supply facility of claim 2 wherein the channel is an articulated path having a first end terminating adjacent a first one of the end portions and a second end terminating at a second one of the end portions.

* * * * *